US010465991B2

(12) United States Patent
Van Bockryck et al.

(10) Patent No.: US 10,465,991 B2
(45) Date of Patent: Nov. 5, 2019

(54) PLATE HEAT EXCHANGER AND METHOD FOR MANUFACTURING A PLATE HEAT EXCHANGER

(71) Applicant: Bosal Emission Control Systems NV, Lummen (BE)

(72) Inventors: Yvo Van Bockryck, Zonhoven (BE); Martijn Luyck, Hasselt (BE); Jean-Paul Hubert Janssens, Leopoldsburg (BE)

(73) Assignee: Bosal Emission Control Systems NV, Lummen (BE)

( * ) Notice: Subject to any disclaimer, the term of this patent is extended or adjusted under 35 U.S.C. 154(b) by 87 days.

(21) Appl. No.: 15/451,841

(22) Filed: Mar. 7, 2017

(65) Prior Publication Data

US 2017/0254598 A1 Sep. 7, 2017

(30) Foreign Application Priority Data

Mar. 7, 2016 (EP) ..... 16158985

(51) Int. Cl.
*F28D 9/00* (2006.01)
*F28F 3/08* (2006.01)
*F28F 3/10* (2006.01)

(52) U.S. Cl.
CPC ..... *F28D 9/0062* (2013.01); *F28F 3/08* (2013.01); *F28F 3/10* (2013.01); *F28F 2240/00* (2013.01);
(Continued)

(58) Field of Classification Search
CPC ... F28D 9/0062; F28F 3/08; F28F 3/10; F28F 2240/00; F28F 2255/02; F28F 2260/02; F28F 2265/16; F28F 2275/06; F28F 3/025
See application file for complete search history.

(56) References Cited

U.S. PATENT DOCUMENTS 9,927,184 B2 * 3/2018 Fujita ..... F28D 9/0062
2017/0074594 A1 * 3/2017 Wollants ..... F28F 3/10

FOREIGN PATENT DOCUMENTS

EP 1373819 A1 1/2004
EP 2244046 A2 10/2010
(Continued)

OTHER PUBLICATIONS

Extended European Search Report for European Patent Application No. 16158985.8, dated Sep. 15, 2016.

*Primary Examiner* — Jon T. Schermerhorn, Jr.
(74) *Attorney, Agent, or Firm* — Merchant & Gould P.C.

(57) ABSTRACT

The plate heat exchanger and method for manufacturing a plate heat exchanger comprise a stack of heat transfer plates, with first and second flow channels arranged between the plates. Pairs of heat transfer plates form cells. A cell comprises inner spacing elements arranged between the heat transfer plates leaving open a first inlet opening and a first outlet opening for the one of the fluids. The cell also comprises outer spacing elements welded to the heat transfer plates on the sides of the heat transfer plates facing away from each other. The cells are stacked against each other and joined together by welding via the outer spacing elements. The plate heat exchanger further comprises cover plates for covering sides of the stack of heat transfer plates with interruption for an inlet port section formed by the first inlet openings and an outlet port section formed by the first outlet openings. The two first sides of the cell comprising the first inlet opening or the first outlet opening comprise leakage passageways provided between the heat transfer plates for the one of the fluids, in addition to the passages provided by the first inlet opening and the first outlet opening.

20 Claims, 3 Drawing Sheets

(52) U.S. Cl.
CPC ..... *F28F 2255/02* (2013.01); *F28F 2260/02* (2013.01); *F28F 2265/16* (2013.01); *F28F 2275/06* (2013.01)

(56) References Cited

FOREIGN PATENT DOCUMENTS

| | | | |
|---|---|---|---|
| EP | 2583045 | A2 | 4/2013 |
| GB | 2091407 | A | 7/1982 |
| WO | 2015/141634 | A1 | 9/2015 |

* cited by examiner

PLATE HEAT EXCHANGER AND METHOD FOR MANUFACTURING A PLATE HEAT EXCHANGER

REFERENCE TO RELATED APPLICATION

This application claims the benefit of EP Application No. 16158985.8, filed on Mar. 7, 2016, in the European Patent Office, the disclosure of which is incorporated herein by reference in its entirety.

The invention relates to a plate heat exchanger and a method for manufacturing a plate heat exchanger.

In plate heat exchangers several heat transfer plates form a stack. In between the heat transfer plates, channels are formed for guiding a heat absorbing medium and a heat emitting medium. In between the plates spacers are provided for keeping the plates at predefined distances and for forming the channels. For example, in the European patent EP 1 373 819 a plate heat exchanger is described, wherein inner and outer spacing elements are arranged between the heat transfer plates. Through welding of the spacing elements to each other, to the heat transfer plates, as well as welding of inlet- and outlet junction channels to the stack, a self-supporting, gas-tight structure is formed. The intense welding in the heat exchanger described in the European patent EP 1 373 819 leads to high residual stress in the stack. Among others, this may lead to cracks. Thus, resistance of the stack may fail and endurance of the plate heat exchanger is significantly diminished.

Therefore, there is a need for a plate heat exchanger and method for manufacturing a plate heat exchanger having improved endurance compared to prior art heat exchangers. In particular, there is need for a plate heat exchanger and method for manufacturing a plate heat exchanger having reduced residual stress in and between individual plates.

According to an aspect of the invention, there is provided a plate heat exchanger comprising a stack of heat transfer plates. Each heat transfer plate extends in a general plane and comprises four edge parts. First and second flow channels are arranged between the plates, with every first flow channel provided for a through-flow of a first fluid and every second flow channel for a through-flow of a second fluid. The first flow channels for one of the fluids are via first inlet openings and first outlet openings connectable to an inlet port and an outlet port of the heat exchanger. In the heat exchanger according to the invention pairs of heat transfer plates form cells. A cell comprises inner spacing elements arranged between the heat transfer plates. The inner spacing elements extend along the four edge parts leaving open a first inlet opening and a first outlet opening for the one of the fluids. The cell further comprises outer spacing elements arranged and welded to at least one of the heat transfer plates on at least one of the sides of the heat transfer plates facing away from each other, along at least two of the four edge parts. The cells are stacked against each other, preferably on top of each other and joined together by welding via the outer spacing elements. Thereby, outer spacing elements may be welded to each other or to a heat transfer plate, depending on the construction of an individual cell as will be described in more detail below.

The plate heat exchanger further comprises cover plates for covering sides of the stack of heat transfer plates. The cover plates cover first two sides of the stack of heat transfer plates with interruption for an inlet port section formed by the first inlet openings and for an outlet port section formed by the first outlet openings. The first two sides of the cell comprising the first inlet opening or the first outlet opening comprise leakage passageways provided between the heat transfer plates for the one of the fluids. The leakage passageways are provided in addition to the passages provided by the first inlet opening and the first outlet opening.

It has been found that small leaks in a stack of a plate heat exchanger in channels for a same fluid do not or not significantly alter the performance of the heat exchanger. In particular in heat exchangers for high temperature applications, wherein one of two fluids may have temperatures up to about 1000 degree Celsius, no or no significant performance reduction has been found by the provision of small leaks. Leakage passageways may simply be provided and are preferably provided by less welding of elements of the heat exchanger to each other. Thus, a manufacturing process of the heat exchanger may become faster and more cost efficient. In addition, with less welding of elements of the heat exchanger a less rigid set-up of a stack may be provided such that lower residual stress in and between elements of the heat exchanger is present during manufacturing or is caused during use. Thus, a risk of cracks being formed in the stack may be lowered as may the risk of weld joint failure. In particular, the avoidance of cracks may improve reliability due to cracks tending to enlarge in an uncontrollable manner and generally allowing a mixture of different fluid flows in the heat exchanger.

The plate heat exchanger according to the invention has a higher endurance than overall welded stacks, which may lead to a longer operational lifetime of the heat exchanger according to the invention.

A cell setup of the plate heat exchanger is defined for one of the fluids, wherein one of the fluids may be one of the first fluid or of the second fluid. Preferably, a first fluid is a gas. Preferably the first fluid is a heat absorbing fluid or cool fluid. Preferably, a second fluid is a gas. Preferably, the second fluid is a heat emitting fluid or hot fluid. Temperatures of the hot fluid may be up to about 1000 degree Celsius, for example may be between 600 Celsius and 950 degree Celsius.

The leakage passageways may be arranged between the heat transfer plates and the (inner) spacing elements along the two edge parts of the heat transfer plates of the first two sides of the cell comprising the first inlet opening or first outlet opening.

Preferably no weld joints are present along the entire two sides of the cell comprising the first inlet opening or first outlet opening. Preferably, no weld joints are present along two entire edge parts of the heat transfer plate of the first two sides comprising the first inlet opening or first outlet opening. The 'entire' edge part of the plate is herein understood to include the entire edge part minus a corner portion, where spacing elements arranged along the two edge parts and other two edge parts of the heat transfer plate meet. Preferably also cover plates are welded to the stack at corner portions.

No weld joints along the edge parts of heat transfer plate and inner spacing element does preferably exclude any weld joints between heat transfer plate and inner spacing element along these edge parts. However, fixing means may be provided to support manufacturing of the cell or of an entire stack to prevent displacement of elements of the stack. Such fixing means may be spot weld joints. Spot weld joints are very few and localized weld joints that may be provided for relatively fixing heat transfer plates and inner and outer spacing elements upon manufacturing. Other fixing means may be adhesives that may be applied between heat transfer plate and spacing elements. An adhesive may have the advantage to be dissipated under hot operation condition of a heat exchanger. Assembled elements of a cell, several cells or of an entire stack may be fixed against relative displacement by external forces such as a clamping force before welding.

The leakage passageways in the first two sides of the cell comprising the inlet or outlet opening may each have a size such that in combination with the cover plates covering said first two sides of the cell, a leakage amount through the leakage passageways of each of the first two sides is larger than zero percent of a flow volume of the one of the fluids through the corresponding first inlet opening or first outlet opening arranged in said first two sides of the cell.

The leakage passageways in the first two sides of the cell comprising the inlet or outlet opening may each have a size such that in combination with the cover plates covering said first two sides of the cell, a leakage amount through the leakage passageways of each of the first two sides has a maximum of 1 percent, preferably a maximum of 0.5 percent, for example 0.1 percent or 0.2 percent, of a flow volume of the one of the fluids through the corresponding first inlet opening or first outlet opening arranged in said first two sides of the cell.

Thus, in a heat exchanger according to the invention, the total of leakage passageways in the first two sides of a stack comprising the inlet or outlet openings have a size such that in combination with the cover plates covering said first two sides of the stack, a leakage amount through the total of leakage passageways of each of the first two sides of the stack has a maximum of 1 percent, preferably a maximum of 0.5 percent, for example 0.1 percent or 0.2 percent, of a flow volume of the one of the fluids through the corresponding first inlet openings or first outlet openings of said first two sides of the stack. While the maximum leakage amount may pass through the sides of the heat exchanger stack, it always remains within the heat exchanger. Preferably, a fluid flow inadvertently leaving the heat exchanger to the environment is zero or undetectable low.

A leakage amount or leakage flow volume through the two sides of a cell comprising the first inlet or first outlet opening and in particular through the sides of an entire stack is defined and dependent on the size of the leakage passageways. Due to the cover plate covering the sides of the stack, a tight mounting of the cover plates may limit or hinder a leakage flow such that a total leakage amount may be the combination of the leakage passageways with the cover plates. Thus, such combination may include a gap size between heat exchanger stack and cover plate on the sides of the first inlet openings or outlet openings.

Preferably, the cover plates are not welded to the sides of the stack, except for a fluid-tight, preferably gas-tight, welding along edges or corner portions of the heat exchanger stack. Preferably, heat exchanger stack and cover plates provide a flush arrangement of the cover plates with the sides of the stack.

The sizes of the leakage passageways and the arrangement of the cover plates are selected to define a maximum leakage amount acceptable for a good performance of the heat exchanger. It has been found that a heat exchanger having leakage passageways and gaps selected to be within the above given leakage amount, the performance of the heat exchanger is reduced by a maximum of 5 percent, in general the performance is reduced by less than 2 percent or less than 1 percent, in particular by less than 0.2 percent, or less than 0.1 percent. It has also been found that leakage passageways and gaps within the above given leakage amount may be achieved using conventional manufacturing tools such as laser welding tools and allow the manufacturing of a heat exchanger stack conveniently keeping manufacturing tolerances.

Sizes of leakage passageways may be in a range between 0.005 millimeter and 1.2 millimeter, preferably between 0.01 millimeter and 0.8 millimeter.

A gap between heat exchanger stack and a cover plate may be between 0.1 millimeter and 5 millimeter, preferably between 0.2 millimeter and 3 millimeter, for example 2 to 3 millimeter.

It has been found that a heat exchanger having leakage passageways and gaps within the above given ranges may achieve leakage amounts within the above given ranges and accordingly allows to manufacture heat exchangers having performance reductions in the range as mentioned above.

A fluid in a stack is substantially on a same pressure level, preferably at atmospheric pressure, in its respective flow channels along the stack, and on about a same temperature level at same or similar locations in the stack. Thus, a leakage flow leaving a cell may possibly pass from one cell to another cell in the stack but only to a channel of a cell for the same fluid. Fluid transfer from a first fluid to a second fluid is not possible or avoided by fluid-tight, preferably gas-tight welding of heat transfer plates and outer spacing elements of a second channel for a second fluid as well as of heat transfer plates and inner spacing elements on second two sides of a cell.

Since leakage may only occur from one cell to another cell within the same fluid, the fluid is not lost to the heat exchanger or to the heat exchanging function of the heat exchanger, respectively.

Preferably, a leakage amount is chosen and varied by the sizes of the leakage passageways. For example, small leakage amounts may be provided by selecting a spacing element being arranged substantially flush with the heat transfer plate along the edge parts of the heat transfer plate. By not welding the plate and the inner spacing element together, a small leakage passageway is formed there between. For example, slits may be provided between spacing element and heat transfer plate on the two sides of the cell comprising the first inlet opening and first outlet opening. The slits may be present due to the non-welding of the contact region of heat transfer plate and spacing element and manufacturing and mounting tolerances. Slits or the form of passageways may also be defined by the form of the spacing element. For example, leakage amounts may be provided by selecting a spacing element having a form not exactly or entirely corresponding to the plane of the edge parts of the heat transfer plates, for example having no exact plane shape. Upon mounting such a spacing element and heat transfer plate, the two elements do not touch on the entire length the spacing element is arranged. Heat transfer plate and spacing element may touch at individual locations only. In between these locations, leakage passageways of differently selectable sizes are formed.

Spacing elements may for example be rectangular, longitudinal spacing elements as known in the art as spacers between heat transfer plates. However, inner spacing elements may be constructed to also be arrangeable in inlet openings and outlet openings. Inner spacing elements may comprise an open portion such as for example inner spacing elements as described in EP 1 373 819. In the heat exchanger of EP 1 373 819 the inner spacing element is arranged along an entire edge part of the heat transfer plate. The open portion of the inner spacing element is arranged in the inlet portion or the outlet portion, respectively.

Spacing elements arranged along an entire edge part of a heat transfer plate, are preferably of regular shape along the entire edge part. This facilitates manufacturing of the spacing elements, in particular also of inner spacing elements.

For example, an inner spacing element may be in the form of a corrugated sheet arranged in the first inlet opening and the first outlet opening. The inner spacing element is preferably arranged along an entire edge part of the plates, thus forming the inner spacing elements for the two sides of the cell comprising the inlet opening and outlet opening. The spaces between the undulations of the corrugated sheet and the heat transfer plate at the first inlet opening form part of the inlet port section and at the first outlet opening form part of the outlet port section of the heat exchanger.

Leakage passageways may also be provided by the material or material construction of the inner spacing element. For example, by providing gas-permeable spacing elements, leakage passageways are formed by the open structure of the material of the inner spacing elements, for example of an open-pored, gas-permeable material, for example metal foam.

Leakage passageways through an inner spacing element may for example also be provided by providing channels through an inner spacing element. If such a spacing element shall also be arranged in an inlet opening or outlet opening, more or larger channels may be provided in that portion of the spacing element arranged in the inlet or outlet opening as, for example, in that other portion of the spacing element arranged in and along the remaining edge part of the heat transfer plate.

The outer spacing elements may be welded to the heat transfer plates by welding energy supplied in a direction parallel to the general plane. The plate heat exchanger thus comprises weld joints between the heat transfer plates along at least two of the four edge parts and the outer spacing elements. If two outer spacing elements are stacked onto each other, then preferably outer spacing elements are also welded to each other by supplying welding energy in a direction parallel to the general plane. The heat exchanger then comprises weld joints between the outer spacing elements along edge parts of the outer spacing elements.

A direction "parallel to the general plane" of the heat transfer plate is herein understood to include a welding direction exactly in the general plane as well as in a direction exactly parallel to the general plane. However, 'parallel' is herein also understood to include directions, which are substantially parallel to the general direction, thus also including small tilting angles between the welding direction and the direction of the general plane. Such small deviation from an exact parallel direction may be due to technical considerations or may include mounting tolerances of for example a welding tool such as a welding laser.

In prior art plate heat exchangers, plates and spacers are generally welded together using perpendicular welding, that is perpendicular to the general plane of the heat transfer plate. Perpendicular welding provides the advantage of less manufacturing tolerances required and still achieving a reliable weld joint. In some prior art heat exchangers, no spacers are used and, for example structured heat transfer plates are directly welded to each other. However, thin heat transfer plates easily deform when being welded directly against each other such that with thin plates preferably spacers are arranged between plates.

In a horizontal welding, a weld joint is formed along an edge by melting material of, for example, a heat transfer plate and an outer spacing element. This is an energy efficient welding through a 'direct' application of welding energy to a welding location and a direct melting of the materials to be welded together. Less energy is required since no welding energy has to pass through the thickness of, for example, a spacer as in a perpendicular or vertical welding process. In addition, in perpendicular welding more energy is introduced into a spacer at the location of the energy input than at further inside arranged portions of the spacer. Thus, thermal expansion of the spacer is large at the one side and small at the other side, leading to deformation (bending) of the spacer. These effects become more prominent the thicker a spacing element the energy has to pass through.

In addition, with horizontal welding no weld material is produced to protrude between heat transfer plate and outer spacing element, between two outer spacing elements, or between two elements in general. Thus with horizontal welding less bulging of plate and spacing element occurs. This allows for a more regular stacking of the components of a heat exchanger. Weld material in interstitials may also lead to undefined or irregular interstitial sizes. Thus, with a horizontal welding, undefined leak sizes due to weld material in interstices between elements to be welded together may be omitted.

Horizontal welding also facilitates or enables maintenance of a heat exchanger. Unintentional leaks or cracks somewhere in a stack side may be closed through access to the stack sides and horizontally welding an edge or corner portion of the stack.

Welding becomes in particular difficult upon welding a 'thin' heat transfer plate to a 'thick' spacing element, which is a preferred arrangement of the heat exchanger according to the present invention. In a perpendicular welding, welding energy has to be sufficient to pass through a thick spacing element and reach the thin heat transfer plate. Next to the above mentioned differences in thermal expansion, large parts of the spacing element are molten and may lead to bulging of the element or additional material in interstices.

With the method and heat exchanger according to the invention, serial production of a heat exchanger is facilitated or made possible. A slowing down of a manufacturing process and waste may be reduced or prevented. In serial production, dimensions of the heat exchanger, parts or semi-finished products thereof must fall within narrow tolerance ranges. Thus, residual stresses that cause deformations, for example during perpendicular welding, and that adversely affect the production process and that may result in high scrap rates, may significantly be reduced or prevented with the method according to the invention.

Preferably, a heat transfer plate in a heat exchanger according to the invention has a thickness or height in a range between 50 micrometer and 300 micrometer, preferably in a range between 100 micrometer and 200 micrometer, for example 150 micrometer.

A distance between successive heat transfer plates in a cell and in a stack may be in a range between 0.5 millimeter and 3 millimeter, for example 1 millimeter or 2 millimeter. Accordingly, inner spacing elements and outer spacing elements may have sizes in same thickness range. Since a distance between heat transfer plates distanced by outer spacing elements is preferably bridged by a double-spacer, the individual outer spacing element has half the thickness of the final distance between the heat transfer plates.

An outer spacing element in a heat exchanger according to the invention may have a thickness or height in a range of between 0.3 millimeter and 1.5 millimeter or between 0.5 millimeter and 3 millimeter, preferably between 0.4 millimeter and 1 millimeter or between 1 millimeter and 2 millimeter, for example 0.5 millimeter or 1 millimeter.

An inner spacing element may have a thickness or height of between 0.5 millimeter and 3 millimeter, preferably, between 0.8 millimeter and 1.5 millimeter, more preferably 1 millimeter. The height of the inner spacing element substantially defines the distance between two heat transfer plates the inner spacing element is arranged in between. If the inner spacing element is a corrugated or otherwise formed sheet, then the height corresponds to a total height defined by the corrugations, while the thickness of the corrugated sheet itself may be much smaller, for example in the range of thicknesses of a heat transfer plate.

The term 'inner' and 'outer' spacing elements are used for illustrative purposes to define an arrangement of elements, such as a cell, that may in a repeatable manner be stacked to form a heat exchanger stack. However, depending on a reference location in a stack an inner spacing element may become an outer spacing element and vice versa.

Using very thin heat transfer plates has the additional advantage of requiring less material and enhancing or supporting a heat transfer through the heat transfer plate. Less material to be used for the heat transfer plate also allows to use more expensive but preferably more corrosive resistant materials.

Substances flowing through a heat exchanger often contain aggressive substances, which may lead to corrosion of the materials in the device if these materials are not sufficiently protected. At high temperatures corrosion is even encouraged. In order to protect heat transfer plates from corrosion in aggressive atmosphere, for example austenitic steel plates are covered with a protective coating, for example an aluminium oxide coating.

When using thin heat transfer plates, for example having thicknesses of, for example, less than 250 micrometer, more expensive material may be used without enhancing overall manufacturing cost. In particular, the reduction in an amount of material used for the heat transfer plates, generally in combination with a dispensable coating process, manufacturing cost may even be reduced. For example, due to their corrosion resistance austenite nickel-chromium-based superalloys such as, for example, Inconel®, such as Inconel 617, 602 or 693, or Incoloy® may enhance a lifetime of a heat exchanger. Also other nickel-based alloys such as for example Monel® provide a very good corrosion resistance. In particular, Inconel alloys 617, 602 and 693 combine good resistance against corrosion at high temperatures (for example 700 to 1000 degree Celsius). In addition, they are suited for cold forming of a desired heat transfer plate, for example of thin (e.g. 0.150 micron) profiled plates (e.g. having a peak-to-peak distance of profiles of about 1 mm). This is particularly advantageous for mass production of such plates.

Since high corrosion resistant materials may be expensive (cost/kg), preferably, only the heat transfer plates are manufactured from these materials. The spacers may be made of a lower grade and thus more cost efficient material such as, for example, an austenitic steel.

Inconels, for example, have a different thermal expansion coefficient as compared to austenitic (steel) materials. This may introduce stress during operation of the heat exchanger (E.g. Inconel 617 has 14.0.10-6 as average coefficient of thermal expansion at 20-1000° C.), while austenitic alloy 1.4835 has 19.5.10-6). However, in the heat exchanger according to the invention, not all plates are welded to all spacers and/or not over an entire edge of the plates. Thus, spacer and plate may locally glide and even out different thermal expansion. For example, while a spacer due to its higher mass expands, the plate may stretch elastically due to its thinness. Thermal stress is also reduced by the provision of welds having a small cross section, which may be achieved by a horizontal or planar welding.

The method according to the invention, in particular in combination with a horizontal welding, favours the manufacture of heat exchangers using thin heat transfer plates, having thicknesses of for example, less than 300 micrometer. It also favours the use of more expensive but more resistant materials.

In some preferred embodiments of the heat exchanger according to the invention, the heat transfer plates are made of a nickel based alloy having a nickel content of preferably more than 60% nickel, in particular are made of a superalloy such as for example Inconel® or Incoloy®. The heat transfer plates may for example be made of Inconel®, Incoloy® or Monel®.

Preferably, the spacers are made of an austenitic steel, for example an austenitic high temperature steel.

In these preferred embodiments the heat transfer plates may have thicknesses smaller than 300 micrometer, preferably smaller than 200 micrometer, for example have a thickness of 150 micrometer. In these preferred embodiments, a distance between subsequent heat transfer plates may be between 0.5 millimeter and 1.5 millimeter, for example 1 millimeter.

Preferably, all weld joints in the heat exchanger according to the invention are manufactured with the same welding equipment and welding technique. Preferably, also the welding of cover plates to edges and corners of a stack, application of inlet and outlet ports, as well as welding of optional further elements of the heat exchanger such as, for example, collars for second fluid inlet ports and second fluid outlet ports, collectors and similar are preformed using welding in a direction perpendicular to the general direction of the heat transfer plates or horizontal welding.

Preferably, laser welding is applied using commonly available welding equipment, such as for example solid state lasers such as Nd-YAG lasers (neodymium doped yttrium aluminium garnet laser) or gas lasers such as $CO_2$ lasers. A diameter of a laser focus is preferably between 30 micrometer and 80 micrometer, for example 40 micrometer to 50 micrometer. Such small spot diameters are in particular suited or required for welding thin heat transfer plates.

Small spot diameters also focus welding energy to the location the energy is used such that welding may be performed using a minimum of energy.

However, high precision may be required with respect to manufacturing tolerances of elements to be welded together and with respect to an alignment of said elements before welding. Since welding using lasers is not performed in gaps, gaps between heat transfer plate and spacing element or between two spacing elements are to be avoided.

Parallel welding, in particular in combination with thin elements to be welded, requires high precision in positioning the elements of the heat exchanger stack. To support a tight alignment of heat transfer plate and spacing elements and to limit or suppress a displacement of the elements before or during welding, a cell or stack may be clamped, for example by external clamping means. To provide or improve a clamping effect, some elements of the heat exchanger or of a cell of the heat exchanger, respectively, may be provided with a certain flexibility or compressibility.

The inner spacing elements arranged between the heat transfer plates on the first two sides of the cell comprising the first inlet opening or first outlet opening may comprise a predefined flexibility in a direction perpendicular to the direction of the general plane. In other words, the inner spacing elements arranged along the first two sides of a cell, allow to compress the cell to a certain predefined amount resulting in a corresponding force exerted by the compressed inner spacing elements outwardly into a direction perpendicular to the general plane.

The flexibility and non-welding of inner spacing elements provides a certain resilience of the stack reducing stress in the stack based for example on twisting of the stack or temperature differences in the stack. However, flexibility also supports manufacturing of the heat exchanger stack. The flexibility of the inner spacing elements provides a certain force onto the heat transfer plates arranged above and below the inner spacing element when a certain compression force is applied from above and below the heat transfer plates (perpendicular to the general plane). This supports a reliable welding due to the heat transfer plates and outer spacing elements being tightly pressed together by the force applied through the flexibility of the inner spacing elements. Thus, heat transfer plate and outer spacing element are made to closely abut each other, preferably along an entire edge part of the heat transfer plate but at least along edge parts where the flexible inner spacing elements are arranged.

The predefined flexibility of the inner spacing elements may be provided by the form of the inner spacing elements or, for example, also by the material the inner spacing element is made of. Preferably, the inner spacing elements are corrugated sheets. These may not only be arranged along an entire edge part of a heat transfer plate as described above (longitudinal direction of the spacing element) but at the same time provide a predefined flexibility and compressibility in the perpendicular direction.

Preferred examples of inner spacing elements have a predefined flexibility and are capable of providing a certain force into the direction perpendicular to the general plane of the heat transfer plates when the inner spacing element is compressed in a perpendicular direction or when the heat transfer plates above and below the inner spacing element or the stack is pressed together. Further examples of flexible inner spacing elements are blocks of a gas-permeable, flexible material, for example a high temperature resistant flexible material.

Inner spacing elements arranged between heat transfer plates on the first two sides of the cell comprising the first inlet opening or first outlet opening may have a height, which height is larger than the height of inner spacing elements arranged on second two sides of the cell not comprising the first inlet opening or the first outlet opening.

The flexibility of the inner spacing elements arranged in the first two sides of the stack allows a compression of these spacing elements at least to a height defined by the height of the other inner spacing elements arranged on the second two sides of the stack. The other inner spacing elements arranged on the second two sides of the stack are preferably not compressible.

The compressible and slightly thicker inner spacing elements guarantee a pressing force acting on the heat transfer plates. Thus, different heights of spacing elements may support the welding process. The inner spacing elements arranged along the edges of the first two sides may have a height, which is larger than the height of the inner spacing elements arranged along the edges of the second two sides by about 1 percent to 20 percent, preferably by about 5 percent to 10 percent.

As a general rule, whenever the term "about" is used in connection with a particular value throughout this application this is to be understood such that the value following the term "about" does not have to be exactly the particular value due to technical considerations. However, the term "about" is understood as explicitly including and disclosing the respective boundary value. In addition, whenever a value is mentioned throughout this application, this is to be understood such that the value is explicitly disclosed. However, a value is also to be understood as not having to be exactly the particular value due to technical considerations.

The heat transfer plates in the heat exchanger according to the invention may comprise a corrugation pattern. Corrugations may have an influence on the flow characteristic of the fluid in the flow channels. By corrugations, for example, flow paths or back pressure of a fluid in the channels may be selected, which may be used for optimization of the heat exchanger. In addition, corrugations may enhance a total surface area of a heat transfer plate and by this a total active area of the heat transfer plate usable for heat transfer from a heat emitting to a heat absorbing fluid. Preferably, a corrugation pattern is provided on a surface of a heat transfer plate. A corrugation pattern may be pressed into the surface of the heat transfer plate, for example, upon manufacturing of the plate. A corrugation pattern may be applied to a surface of a heat transfer plate.

According to another aspect of the invention, there is provided a method for manufacturing a plate heat exchanger comprising a stack of heat transfer plates. The method comprises the steps of arranging heat transfer plates in a stack, each heat transfer plate extending in a general plane and comprising four edge parts. First flow channels and second flow channels are provided between the heat transfer plates, with every first flow channel for a through-flow of a first fluid and every second flow channel for a through-flow of a second fluid. The first flow channels for one of the fluids may be connected via first inlet openings to an inlet port and via first outlet openings to an outlet port. The method comprises the step of forming cells by pairs of heat transfer plates, and by arranging inner spacing elements between the heat transfer plates of a cell. The inner spacing elements extend along the four edge parts of the heat transfer plates leaving open a first inlet opening and a first outlet opening for the one of the fluids. The step of forming cells further comprises providing outer spacing elements and welding the outer spacing elements to at least one of the heat transfer plates on at least one of the sides of the heat transfer plates facing away from each other, along at least two of the edge parts. Yet a further step of the method comprises stacking the cells against each other and joining the cells by welding the outer spacing elements. The joining of the cells may be performed by welding an outer spacing element of one cell to an outer spacing element of another cell together to form a double spacer in between the two cells. Welding two cells together may also be performed by welding an outer spacer of one cell to a heat transfer plate of another cell.

Accordingly, the at least two outer spacing elements may be welded one to one heat transfer plate and another one to the second heat transfer plate of the cell, or both outer spacing elements may be welded to at least two edge parts of one heat transfer plate of the cell, or at least two outer spacing elements each may be welded to at least two edge parts of two heat transfer plates of a cell.

By providing cover plates and covering sides of the stack of heat transfer plates, first two sides of the stack of heat transfer plates are covered with interruption for an inlet port section formed by the first inlet openings and an outlet port section formed by the first outlet openings.

Further method steps comprise welding together the heat transfer plates and the inner spacing elements on second two sides of the cell not comprising the first inlet opening or first outlet opening and providing leakage passageways between the heat transfer plates in the first two sides of the cell for the one of the fluids, in addition to the passage of the first inlet opening and the first outlet opening. The leakage passageways may be provided by not welding together the heat transfer plates and the inner spacing elements on the first two sides of the cell comprising the first inlet opening or first outlet opening.

By welding together the heat transfer plates and the inner spacing elements on second two sides of the cell not comprising the inlet opening or outlet opening a fluid-tight, preferably, gas-tight connection is formed on the second two sides of the cell. By not welding together the heat transfer plates and the inner spacing elements on the first two sides of the cell comprising the inlet opening or outlet opening, a leaking of the one of the fluids is allowed to occur through the first two sides of the cell outside of the port sections arranged on those first two sides.

A cell may be premanufactured. A desired number of cells may then be stacked and welded, sequentially or all together, to form a heat exchanger stack. After the stack has been formed, the stack may be provided with cover plates.

The method according to the invention may comprise the step of welding together the heat transfer plates and the outer spacing elements by supplying welding energy in a direction parallel to the general plane to produce weld joints between edge parts of the heat transfer plates and the outer spacing elements.

Preferably, welding together the heat transfer plates and the inner spacing elements on second two sides of the cell not comprising the first inlet opening or first outlet opening is also performed by supplying welding energy in a direction parallel to the general plane to produce weld joints between two edge parts of the heat transfer plates and the inner spacing elements along the two edge parts on the second two sides of the cell.

Preferably, all welding between heat transfer plate and outer spacing elements and heat transfer plate and inner spacing elements, as well as possibly also between two outer spacing elements where applicable, is performed by supplying welding energy in a direction substantially parallel to the general plane to produce weld joints along edge parts.

The method according to the invention may comprise the step of providing a pressing force onto edge parts of the heat transfer plates, thereby pressing inner spacing elements, heat transfer plates and outer spacing elements against each other.

Such pressing force may be applied from outside, for example by providing a force from the top and the bottom of a cell or of an entire stack (force direction perpendicular to the general plane) before and during welding the cell edges or the stack. Preferably, the pressing force is provided by the inner spacing elements arranged along the sides of the cell comprising the first inlet opening or first outlet opening. The inner spacing elements may comprise a predefined flexibility or compressibility such as to apply pressure upon being compressed. The flexibility of the inner spacing elements may be due to their shape or material characteristics or due to a combination of shape and material.

Further aspects and advantages of the method according to the invention have been described relating to the plate heat exchanger according to the invention and will not be repeated.

The invention is further described with regard to embodiments, which are illustrated by means of the following drawings, wherein.

Figure 3:
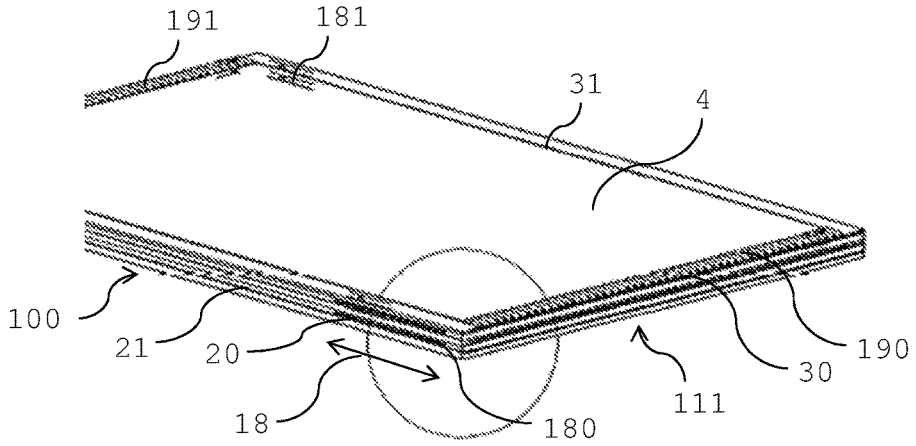
Figure 4:
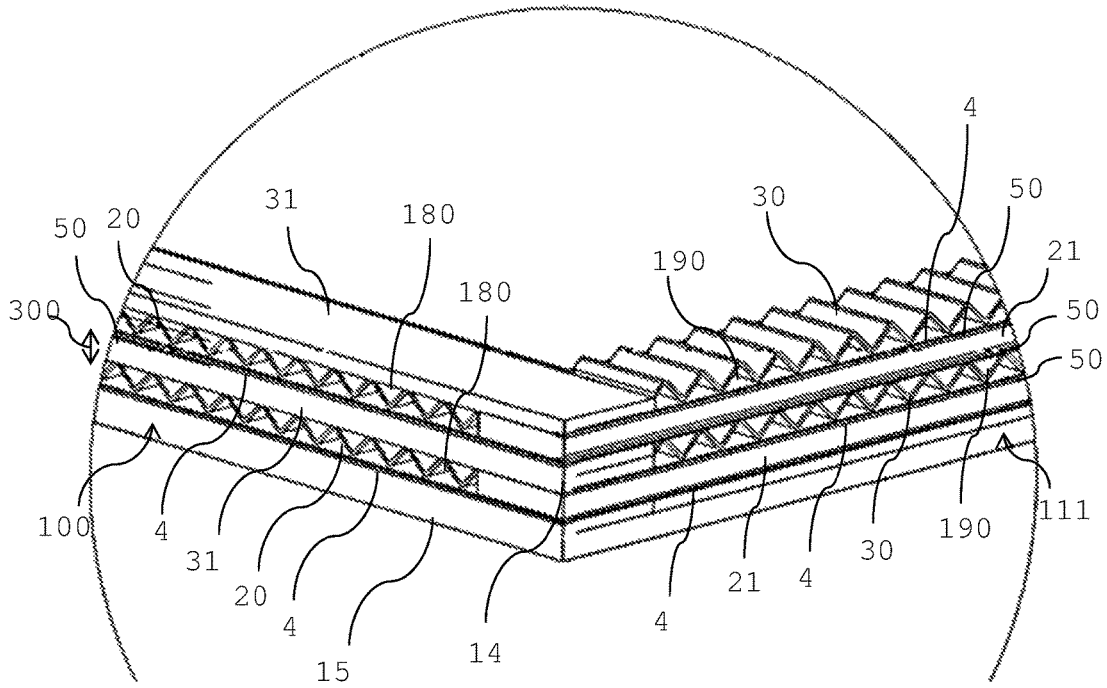
Figure 5:
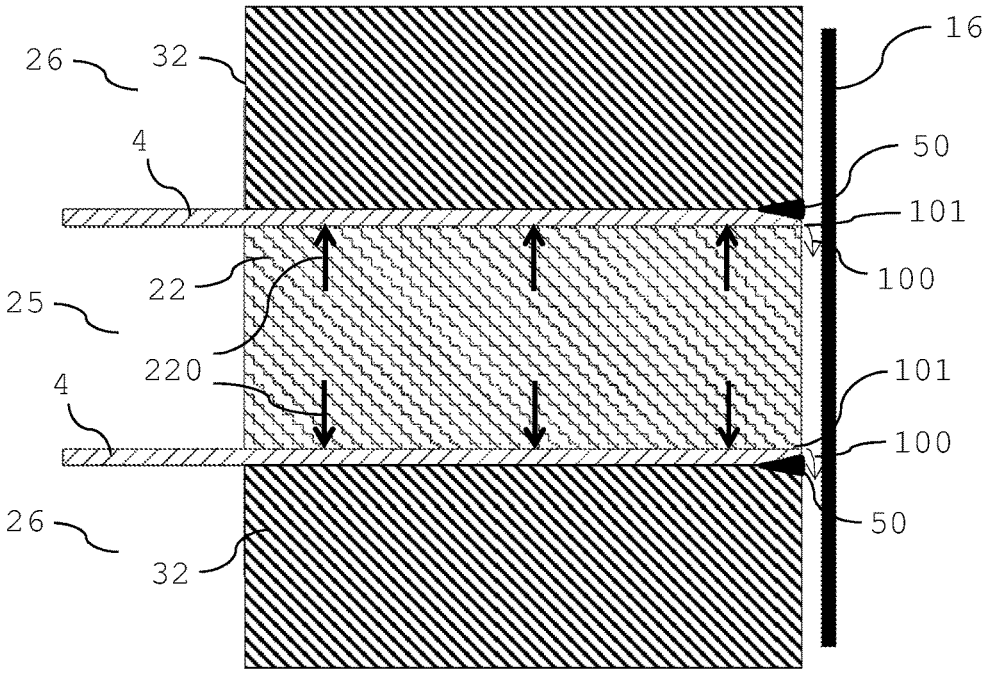
Figure 6:
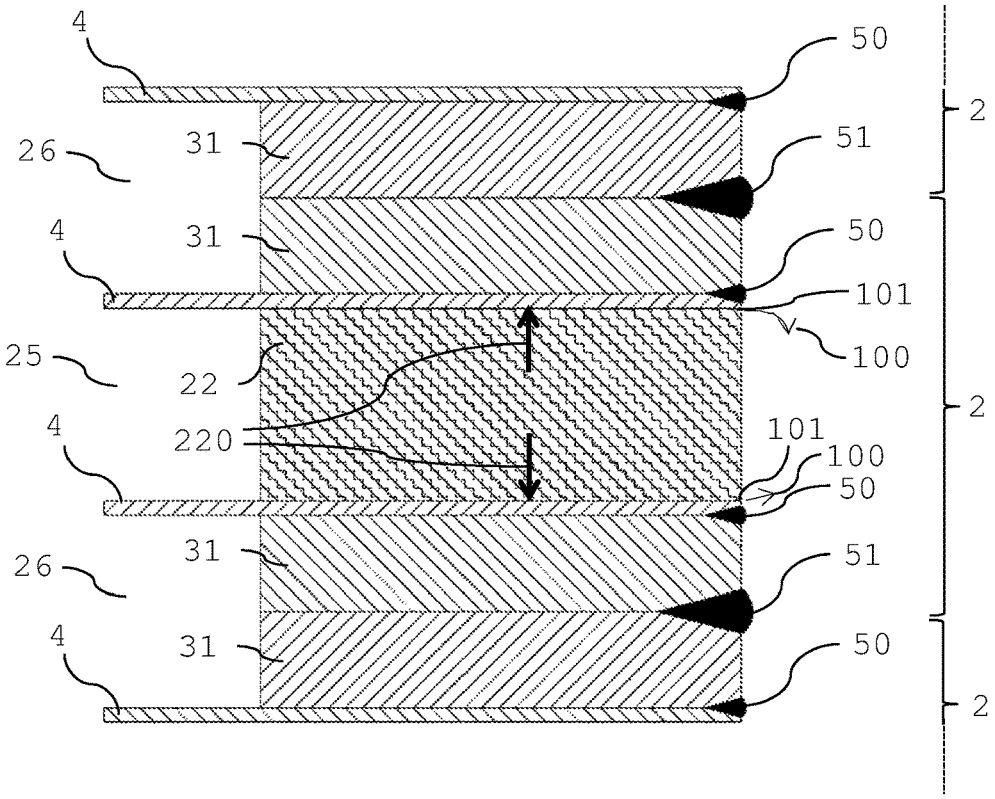

FIG. 3 schematically illustrates an arrangement of elements of a plate heat exchanger;

FIG. 4 is an excerpt of the arrangement of FIG. 3;

FIG. 5 illustrates a cross-section through an embodiment of a heat exchanger set-up with welding details;

FIG. 6 illustrates a cross-section through another embodiment of a heat exchanger set-up with welding details.

Figure 1:
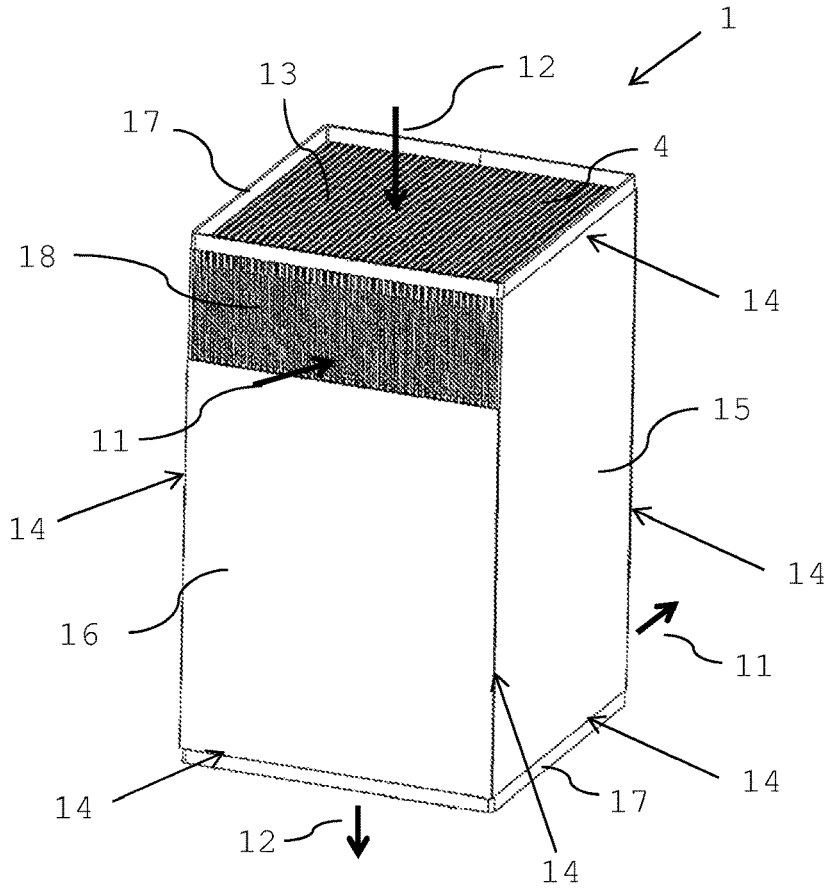
FIG. 1 shows a schematic arrangement of a plate heat exchanger.

FIG. 1 shows a plate heat exchanger 1 comprising a stack of rectangular heat transfer plates 4 divided by spacing elements to form channels in between the heat transfer plates 4. In the stack of the heat exchanger shown in FIG. 1, the rectangular plates are arranged vertically. For example, 20 to 30 plates may be arranged above or next to each other to form a stack.

A first fluid, preferably a cooling gas, may enter the stack 53 at a first inlet port section 18 on a first one of two first sides of the stack. After having passed the stack by flowing through first channels, the first fluid 11 may leave the heat exchanger at the opposite second one of the two first sides (in the figure to the back).

A second fluid 12, preferably a hot gas, may enter the stack at a second inlet port section 13 on a first one of two second sides of the stack. After having passed the stack by flowing through second channels, the second fluid 12 may leave the heat exchanger at the opposite second one of the two second sides or a bottom side in FIG. 1.

A first cover plate 16 covers the first one of the two first sides of the heat exchanger but for the inlet port section 18 arranged versus a first top end of the heat exchanger. The first outlet port section (not shown) is constructed likewise but on the opposite side of the heat exchanger versus a bottom end of the stack. This cover plate set-up may be used for embodiments of a heat exchanger, where an open inner spacing element, such as a corrugated sheet, is arranged along entire first sides of the heat exchanger. The sizes of the inlet and outlet port sections are then mainly defined by the arrangement of the cover plate. This cover plate set-up may be also be used for embodiments of the heat exchanger, where no spacing element or an open inner spacing element, such as a corrugated sheet, is solely arranged in the inlet or outlet openings, that is, along a portion of the first sides of the heat exchanger only. The inlet and outlet port sections are then mainly defined by the inlet and outlet openings. The first cover plate 16 (and opposite side of the stack accordingly) covers about ⅔ or ⅘ of the first one side of the stack.

The second inlet port section 13 extends over the entire top of the heat exchanger 1 and the second outlet port section (not shown) extends over the entire bottom of the heat exchanger 1. The first and the second fluid are guided in alternating first and second channels through the stack and in the application described essentially parallel to each other.

Cover plates 15 entirely cover two third sides of the stack. The bottom and top of the stack may be provided with collars 17 for application of corresponding collectors.

Preferably, the cover plates 15,16 are welded together and to the stack along edge or corner parts 14. The cover plates 15 on the two third sides are welded along their four edge parts 14. The cover plates 16 on the two first sides are welded along three edge parts 14 but preferably not along the edge part forming the first inlet or outlet port sections 18.

Figure 2:
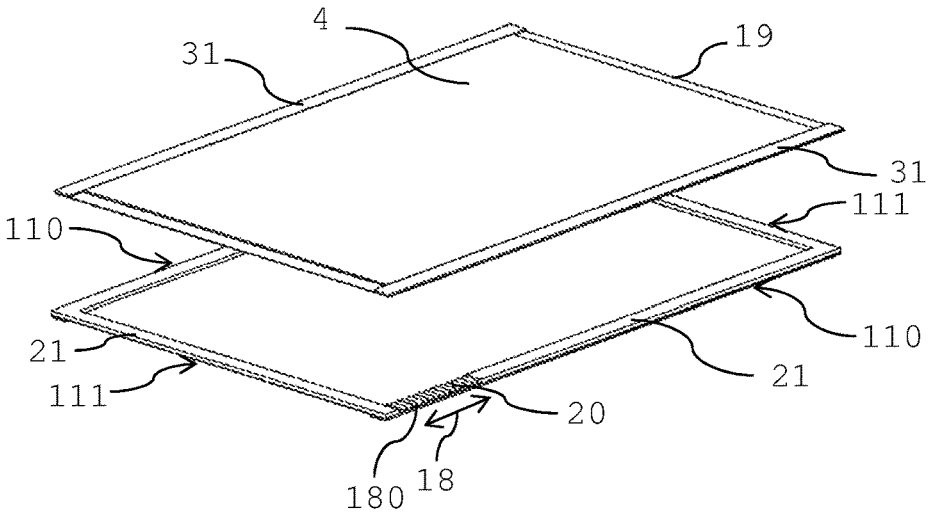
FIG. 2 shows elements of a cell of a plate heat exchanger.

In the exploded view of FIG. 2 a simplified cell is shown, which cell may be used to form a plate heat exchanger by stacking several cells above or next to each other if provided by a further heat transfer plate (which has been omitted from the drawing).

Spacing elements in the form of straight rectangular spacers 31, for example stainless steel spacers in particular austenitic high temperature steel spacers, are arranged on a top side of a heat transfer plate 4 and along the entire edges of two opposite first sides 110 of the heat transfer plate 4. The two opposite second sides 111 on the top of the heat transfer plate 4 are not provided with spacing elements and form corresponding inlet and outlet openings 13 for a second fluid to be guided along the top side of the heat transfer plate 4. The spacers have a height of, for example, 0.5 millimeter and are a half of a double-spacer.

L-shaped rectangular spacing elements 21, for example L-shaped stainless steel spacers in particular austenitic high temperature steel spacers are arranged along the entire two opposite second sides 111 on the bottom of the heat transfer plate 4, as well as along a portion of the two opposite first sides 110 on the bottom of the heat transfer plate 4. The remaining portions along the edges of the first two sides form a first inlet opening section 18 and a first outlet opening section (not shown) for a first fluid to be guided into and out of the first channel formed along the bottom side of the heat transfer plate 4. Heat transfer between the first and the second fluids occurs through the heat transfer plate 4, preferably a high corrosion resistant material, for example a nickel-based high corrosion resistant material, for example Inconel® 617, 602 or 693. Preferably, the thickness of the heat transfer plate is below 250 micrometer. The thickness of the heat transfer plates is preferably about 150 micrometer.

In the first inlet opening 180 and the first outlet opening an open spacing element in the form of a corrugated sheet 20 is arranged. The corrugated sheet 20 and the L-shaped spacing element 21 may be integrally formed, formed in one piece or may be separate spacing elements. The corrugated sheet 20 provides sufficient openings for a fluid flow to pass through without causing inacceptable high back pressure. The corrugated sheet serves as spacer also in the inlet and outlet opening section. In addition, the corrugated sheet comprises a certain flexibility and compressibility such that upon applying a force from above and below onto the cell, the corrugated sheet applies a corresponding compressing force onto above and below lying edge portions of the cell or of a stack. The close positioning of the elements guarantee a secure welding and allow application of a minimum and very localized welding energy. Preferably, also the L-shaped spacing element 21 on the two sides comprising the first inlet or outlet opening 180 may apply a force onto above and below lying edge portions of the cell. By this, a pressing force may be applied along the entire two opposite edge parts of the heat transfer plate 4.

The L-shaped spacing element 21 on the two sides comprising the first inlet or outlet opening 180 may, for example be made of a slightly compressible material.

Preferably, the height of the corrugated sheet 20 and the L-shaped spacing element 21 on the two sides comprising the first inlet or outlet opening 180 are preferably about 5 percent higher than the L-shaped spacing element 21 on the two sides not comprising the first inlet and outlet opening. By this an about 5 percent compression of the spacing elements on the two sides comprising the first inlet and outlet opening 180 may be achieved.

The corrugated sheet 20 as well as the L-shaped spacing element 21 are not welded to the heat transfer plate 4 on the two first sides 110 comprising the inlet or outlet opening 180. On the two second sides 111 (not comprising the inlet and outlet opening 180) the spacing element 21 is welded in a fluid-tight, preferably gas-tight manner to the heat transfer plate 4. Also the spacing element 31 on the top of the heat transfer plate is welded to the heat transfer plate in a fluid-tight, preferable gas-tight manner.

The welding is performed in the plane of the heat transfer plate, providing very narrow welds along the edge parts of the heat transfer plates and the respective spacing elements.

The first and second fluid may be at atmospheric pressure or may be pressurized. Preferably, both fluids are at atmospheric pressure. However, one fluid may be at atmospheric pressure and the other fluid may be pressurised, for example with 2, 3 or 4 bar. Experiments have shown that a pressure in this range or pressure differences between fluids in this range has no or no noticeable influence on the amount of leakage fluid passing through the leakage passageways created by the non-welding of some elements and thus has no or no significant negative influence onto a performance of the plate heat exchanger.

In FIG. 3 an exemplary small stack, basically a double cell, is shown, wherein the same or similar elements are provided with the same reference numbers as in FIG. 2. In the embodiment of FIG. 3 the inlet opening 190 and outlet opening 191 for the second fluid 12 as well as the inlet opening 180 and outlet opening 181 for the first fluid 11 is provided with a spacing element in the form of a corrugated sheet 30, 20. The corrugated sheets 20 forming the first inlet 180 and first outlet 181 extend only along a portion of the edge parts of the heat transfer plate on the two opposite first sides 110. The corrugated sheets 30 forming the second inlet 190 and second outlet 191 extend along the entire edge parts of the heat transfer plate on the two opposite second sides 111 of the heat transfer plate 4. The 'entire' edge part of the plate is herein understood to also include the entire edge part minus the width of spacing elements arranged along the other two opposite sides of the heat transfer plate 4.

Exemplary dimensions of a heat transfer plate are preferably between 100 millimeter and 300 millimeter parallel to a flow direction and between 100 millimeter and 400 millimeter perpendicular to the flow direction.

In FIG. 4 an edge portion of the stack of FIG. 3 is shown in an enlarged view. Again the same reference numbers are used for the same or similar elements. The cover plate 15 forms the one side of the stack. A heat transfer plate 4 is arranged next to the cover plate 15. On the next level, a second side 111 is closed by a spacer 21 welded through horizontal welding to the heat transfer plate 4 above and below the spacer 21. The first side 110 is open and provided with a corrugated sheet 20, which may extend over the inlet opening 180 (or outlet opening 181) only as in the example of FIG. 3, or may also extend along the entire first side 110. This first channel is closed by the next heat transfer plate. In a further layer the first side 110 is closed by a spacer 31, while the second side 111 is open and provided with a corrugated sheet 30. This second channel is closed again by a further heat transfer plate 4. The spacer 31 of the further layer is welded in a horizontal manner to this further heat transfer plate 4.

The next level is a repetition of the first channel and formed accordingly, while the level after the next is a repetition of the second channel.

Between the spacers 31 and the heat transfer plates 4 weld joints are provided along the edge parts along an entire side of the heat transfer plate. Weld joints are also provided between spacers 21 and the heat transfer plate 4 on the second sides 111 of the stack not comprising the first inlet or outlet opening 180, 181.

No weld joints are provided between the corrugated sheets 20, 30 and the heat transfer plates 4. Also no weld joints are provided between the heat transfer plates 4 and the spacers (see FIG. 3) on the first sides 110 of the stack comprising the first inlet or first outlet opening 180, 181 such that leakages passageways are formed between said non-welded corrugated sheets 20, 30 or spacers 21 and heat transfer plates 4.

In FIG. 4 the spacers 31 of the second fluid channel are part of a double spacer defining the distance 300 of two heat transfer plates 4 and the height of the second channel. Preferably, the double spacer is formed upon stacking cells to each other each cell having a spacer 31 arranged on its outside.

In the cross-sectional view of FIG. 5 an alternating arrangement of spacing elements 22, 32 and heat transfer plates 4 is shown. The inner spacing element 22 is not welded to the heat transfer plates 4 arranged adjacent to the inner spacing element 22. Thus between the inner spacing element 22 and the heat transfer plate 4 a leakage passageway 101 is formed, where a small leakage flow 100 may exit the flow channel 25.

The outer spacing elements 32 are welded to and along the edges of the heat transfer plates 4 as is indicated by weld joints 50. These weld joints 50 are created by supplying welding energy in a direction parallel to the plane of the heat transfer plates 4, and preferably at the position of the interface between outer spacing element 32 and heat transfer plate 4.

The cover plate 16 covers the side of the stack and hinders the leakage flow 100 to leave the heat exchanger. Due to the gas-tight welding between outer spacing elements 32 and heat transfer plates 4 no communicating path exists between first flow channel 25 and second flow channel 26 or between a respective first fluid flow and a second fluid flow. Thus, the amount of leakage flow 100 leaving a first channel 25 may only enter back into the same or another first channel or possibly leave the stack through a first outlet opening provided for the first fluid to leave the stack.

The inner spacing element 22 has, for example, by its shape or material a certain elasticity. This elasticity allows to slightly compress the inner spacing element 22 when a force is applied onto the spacing element 22 in a direction perpendicular to the stack (from above and below in the drawing). By compressing the inner spacing element 22 the same amount of compressing force 220 is applied to the heat transfer plates 4 above and below the inner spacing element 22. By this, the heat transfer plates 4 are pushed against the outer spacing elements 32, forming a tight contact between them, which supports a proper welding.

In the embodiment of FIG. 5, first and second channels 25, 26 have about a same height, which height is defined by the thickness of the spacing elements 22, 32. Preferably, such a thickness is about 1 millimeter, while the thickness of the heat transfer plates 4 is preferably about 150 micrometer. To weld the heat transfer plates 4 to the outer spacing elements 32, preferably laser welding is used, with a laser spot diameter of about 40 to 50 micrometer.

In the cross-sectional view of FIG. 6 an arrangement of an inner spacing element 22, two outer spacing elements 31 with heat transfer plates 4 is shown. The inner spacing element 22 may be the same as in FIG. 5 and is not welded to the heat transfer plates 4 arranged next to the inner spacing element 22. Again, between inner spacing element 22 and the heat transfer plates 4 a leakage passageway 101 forms, where a small leakage flow 100 may exit the flow channel 25. For simplicity reasons the cover plate is not shown.

The outer spacing elements 31 are again welded by horizontal welding to and along the edge parts of the heat transfer plates 4 as indicated by weld joint 50.

In the embodiment of FIG. 6, first and second channels 25, 26 have about a same height, which height is defined by the thickness of the spacing element 22 and the two spacing elements 31. Preferably, such a thickness is about 1 millimeter, while the thickness of the heat transfer plate is preferably about 150 micrometer. However, the height of the second channel 26 is formed by a double spacer formed by two outer spacing elements 31 welded together as indicated by weld joint 51. Preferably, the outer spacing elements 31 are identical spacers having a same height. Such an embodiment may facilitate manufacturing of a plate heat exchanger. Individual cells 2 comprising an inner spacing element 22 between two heat transfer plates 4, as well as one outer spacer 31 welded to opposite sides of each of the heat transfer plates 4 may be pre-manufactured. A desired plurality of such cells 2 may then be stacked and welded to each other by welding the outer spacing elements 31. Only one kind of cell may be pre-manufactured, not requiring changes in a production process or selection upon stacking cells.

By the pre-manufacturing, the welding between thin heat transfer plates 4 and thick spacing elements 22, 31 requiring precise alignment and welding may be performed in advance. A single cell 2 only comprises few components that need to be aligned and kept in position during welding.

The welding between two thicker outer spacing elements 31 may then also be performed using other welding techniques or using laser welding but possibly using larger focus diameters.

As may well be seen in FIGS. 5 and 6, the horizontal welding or welding in a direction of the general plane of a heat transfer plate does not or only to a very limited extent cause bulging or deformation of the welded elements and causes no undesired weld material in between to be welded elements. Additional weld material due to the melting of the materials of the plate and spacing elements—if produced at all—extends to the side of the stack, extending into a gap between cells 2 and cover plate 16.

Preferably, the inner spacing element 22 also has a certain elasticity in the direction perpendicular to the plane of the heat transfer plate 4 for applying a certain pressing force 220 onto the heat transfer plates 4 and outer spacing elements 31 to support welding between the outer spacing elements 31 and the heat transfer plates 4.

Before horizontal welding is applied along parts of an edge or along an entire edge, small weld spots may be applied between a heat transfer plate and an inner or outer spacing element. Such small weld spots may prevent misalignment of the elements of a cell or of a stack before being fixed to each other.

The invention claimed is:

1. A plate heat exchanger comprising a stack of heat transfer plates, each heat transfer plate extending in a general plane and comprising four edge parts, wherein first and second flow channels are arranged between the plates, with every first flow channel for a through-flow of a first fluid and every second flow channel for a through-flow of a second fluid, the first flow channels for one of the fluids are via first inlet openings and first outlet openings connectable to an inlet port and an outlet port, wherein pairs of heat transfer plates form cells, a cell comprising inner spacing elements arranged between the heat transfer plates, the inner spacing elements extending along the four edge parts leaving open a first inlet opening and a first outlet opening for the one of the fluids, outer spacing elements welded to at least one of the heat transfer plates on at least one of the sides of the heat transfer plates facing away from each other, along at least two of the four edge parts, wherein the cells are stacked against each other and joined together by welding via the outer spacing elements;

the plate heat exchanger further comprising cover plates for covering sides of the stack of heat transfer plates, the cover plates covering first two sides of the stack of heat transfer plates with interruption for an inlet port section formed by the first inlet openings and for an outlet port section formed by the first outlet openings, wherein the first two sides of the cell comprising the first inlet opening and the first outlet opening comprise leakage passageways provided between the heat transfer plates for the one of the fluids, the leakage passageways being provided in addition to the passages provided by the first inlet opening and the first outlet opening.

2. The plate heat exchanger according to claim 1, wherein the leakage passageways are arranged between the heat transfer plates and the inner spacing elements along the two edge parts of the heat transfer plates of the first two sides of the cell comprising the first inlet opening or first outlet opening.

3. The plate heat exchanger according to claim 2, wherein the inner spacing elements arranged between the heat transfer plates on the first two sides of the cell comprising the first inlet opening or first outlet opening comprise a predefined flexibility in a direction perpendicular to the direction of the general plane.

4. The plate heat exchanger according to claim 1, wherein the leakage passageways in the first two sides of the cell each have a size such that in combination with the cover plates covering said first two sides of the cell, a leakage amount through the leakage passageways of each of the first two sides has a maximum of 1 percent of a flow volume of the one of the fluids through the corresponding first inlet opening or first outlet opening arranged in said first two sides of the cell.

5. The plate heat exchanger according to claim 1, wherein the outer spacing elements are welded to the at least one heat transfer plate by welding energy supplied in a direction parallel to the general plane, the plate heat exchanger comprising weld joints between the at least one heat transfer plate along the edge parts and the outer spacing elements.

6. The plate heat exchanger according to claim 5, wherein the outer spacing elements are welded to each other by supplying welding energy in a direction parallel to the general plane comprising weld joints between the outer spacing elements along edge parts of the outer spacing elements.

7. The plate heat exchanger according to claim 5, wherein the inner spacing elements arranged between the heat transfer plates on the first two sides of the cell comprising the first inlet opening or first outlet opening comprise a predefined flexibility in a direction perpendicular to the direction of the general plane.

8. The plate heat exchanger according to claim 1, wherein the outer spacing elements are welded to each other by supplying welding energy in a direction parallel to the general plane comprising weld joints between the outer spacing elements along edge parts of the outer spacing elements.

9. The plate heat exchanger according to claim 1, wherein the heat transfer plates have a thickness in a range between 50 micrometer and 300 micrometer.

10. The plate heat exchanger according to claim 1, wherein the outer spacing elements have a thickness in a range between 0.3 millimeter and 3 millimeter.

11. The plate heat exchanger according to claim 1, wherein the inner spacing elements arranged between the heat transfer plates on the first two sides of the cell comprising the first inlet opening or first outlet opening comprise a predefined flexibility in a direction perpendicular to the direction of the general plane.

12. The plate heat exchanger according to claim 11, wherein the inner spacing elements arranged between the heat transfer plates on the first two sides of the cell comprising the first inlet opening or first outlet opening have a height, which is larger than the height of the inner spacing elements arranged on second two sides of the cell not comprising the first inlet opening or the first outlet opening.

13. The plate heat exchanger according to claim 1, wherein the inner spacing elements are corrugated sheets.

14. A method for manufacturing the plate heat exchanger according to claim 1, the method comprising welding together the heat transfer plates and the inner spacing elements on second two sides of the cell not comprising the first inlet opening and the first outlet opening, and forming the leakage passageways by not welding together the heat transfer plates and the inner spacing elements on the first two sides of the cell comprising the first inlet opening and the first outlet opening.

15. Method according to claim 14, wherein the step of welding together the heat transfer plates and the inner spacing elements on the second two sides of the cell not comprising the first inlet opening and the first outlet opening comprises supplying welding energy in a direction parallel to the general plane to produce weld joints between two edge parts of the heat transfer plates and the inner spacing elements.

16. Method according to claim 15, further comprising the step of welding together the heat transfer plates and the outer spacing elements by supplying welding energy in a direction parallel to the general plane to produce weld joints between edge parts of the heat transfer plates and the outer spacing elements.

17. Method according to claim 15, further comprising the step of providing a pressing force onto edge parts of the heat transfer plates, thereby pressing inner spacing elements, heat transfer plates and outer spacing elements against each other.

18. Method according to claim 14, further comprising the step of welding together the heat transfer plates and the outer spacing elements by supplying welding energy in a direction parallel to the general plane to produce weld joints between edge parts of the heat transfer plates and the outer spacing elements.

19. Method according to claim 14, further comprising the step of providing a pressing force onto edge parts of the heat transfer plates, thereby pressing inner spacing elements, heat transfer plates and outer spacing elements against each other.

20. Method according to claim 19, wherein the step of providing a pressing force onto edge parts of the heat transfer plates comprises providing flexible inner spacing elements.

* * * * *